United States Patent [19]

Friedrich, deceased et al.

[11] Patent Number: 4,700,356

[45] Date of Patent: Oct. 13, 1987

[54] CONTACT JAW FOR AN ELECTRODE MOUNT

[75] Inventors: Hans Friedrich, deceased, late of Moers; Pauline Friedrich, legal representative, Mülheim, both of Fed. Rep. of Germany

[73] Assignee: Fried. Krupp Gesellschaft mit beschränkter Haftung, Essen, Fed. Rep. of Germany

[21] Appl. No.: 860,862

[22] Filed: May 8, 1986

[30] Foreign Application Priority Data

May 11, 1985 [DE] Fed. Rep. of Germany ..... 3517069

[51] Int. Cl.[4] ..... H05B 7/103

[52] U.S. Cl. ..... 373/101

[58] Field of Search ..... 373/101, 94, 99, 100; 174/110 A, 126 CP; 339/278 C, 278 D

[56] References Cited

U.S. PATENT DOCUMENTS 4,323,717 4/1982 Garner et al. ..... 373/101
4,417,097 11/1983 Das ..... 174/110 A

FOREIGN PATENT DOCUMENTS 2258052 4/1973 Fed. Rep. of Germany .
2466168 3/1979 France .
2136660 9/1984 United Kingdom ..... 373/101

*Primary Examiner*—Roy N. Envall, Jr.
*Attorney, Agent, or Firm*—Spencer & Frank

[57] ABSTRACT

A copper contact jaw is insulated from and releasably fastened to an electrode mount (4) of an electric furnace to transfer current from input leads to an electrode (2). A long service life and secure insulation are attained by using hard copper for the contact jaw and by coating the contact jaw, at least at where it faces the electrode mount (4), with a metal adhesion layer and a layer of ceramic insulating material on the adhesion layer.

7 Claims, 4 Drawing Figures

FIG. 2
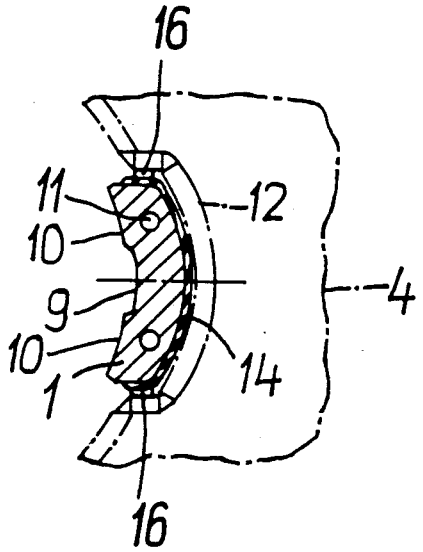
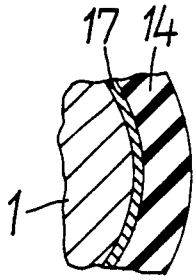
FIG. 4
FIG. 3
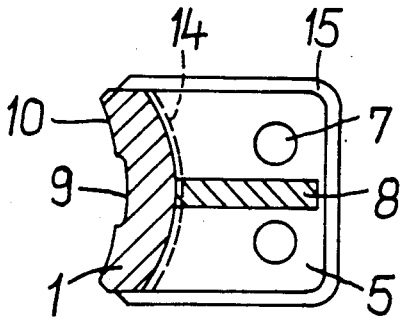

CONTACT JAW FOR AN ELECTRODE MOUNT

BACKGROUND OF THE INVENTION

The present invention relates to a copper contact jaw which is insulated from and releasably fastened to the electrode mount of an electric furnace for the transfer of current from the input leads to the electrode.

In the past, such contact jaws have been cast in one or more parts or have been welded and possibly provided with a stainless steel reinforcement. An insulating layer has been disposed between the contact jaw and the electrode mount to prevent the generation of secondary currents. Since this insulating layer is subject to damage, so that frequent exchange of the insulating layer becomes necessary, it has already been disclosed to overcome this drawback by covering the faces of the electrode mount opposite the contact jaw with a coating of aluminum oxide. However, the thickness of such a coating was found to be insufficient, so that neither a sufficient insulating effect nor a satisfactory service life was realized for the insulating layer.

SUMMARY OF THE INVENTION

It is an object of the present invention to overcome this drawback and to provide a contact jaw of the abovementioned type which is able to withstand very high stresses. This object can be attained by providing a hard copper contact jaw which, at least where it faces the electrode mount, is provided with a metal adhesion layer and a coating of ceramic insulating material on the adhesion layer.

Compared to prior art contact jaws, the contact jaw according to the present invention has the advantage that the layer thickness of the insulating coating can be increased considerably. It is advantageous to laterally support the coating on the contact jaw at a pair of guides disposed at the electrode mount.

Particularly advantageous results are attained if a nickel-aluminum alloy, whose expandability results in good adhesion, is used as the metal adhesion or bonding layer.

The coating of ceramic insulating material is preferably pure aluminum oxide. It is of particular advantage if the coating is applied by a spray process. Particularly great thickness of the coating can be produced if the contact jaw is made out of a chromium-zirconium alloyed and heat treated hard copper in which the zirconium content lies between 0.003 and 0.5% and the chromium content lies between 0.3 and 1.2%. These contents depend, in particular, on the homogeneity of the copper melt, i.e. with great homogeneity the lower limit values may be sufficient. A heat treatment to temper the material before the insulating coating is applied results in an even greater improvement of the mechanical values of the hard copper.

BRIEF DESCRIPTION OF THE DRAWINGS

FIG. 2 is a sectional view along line II—II of FIG. 1, and illustrates the bar and a portion of the electrode mount shown in FIG. 1.

FIG. 3 is a sectional view along line III—III of FIG. 1, and illustrates the bar and the bracket shown in FIG. 1.

FIG. 4 is a sectional view of the bar, shown partially broken away and on an enlarged scale, to illustrate the metal adhesion layer beneath the coating of ceramic insulating material.

DESCRIPTION OF THE PREFERRED EMBODIMENTS

Figure 1:
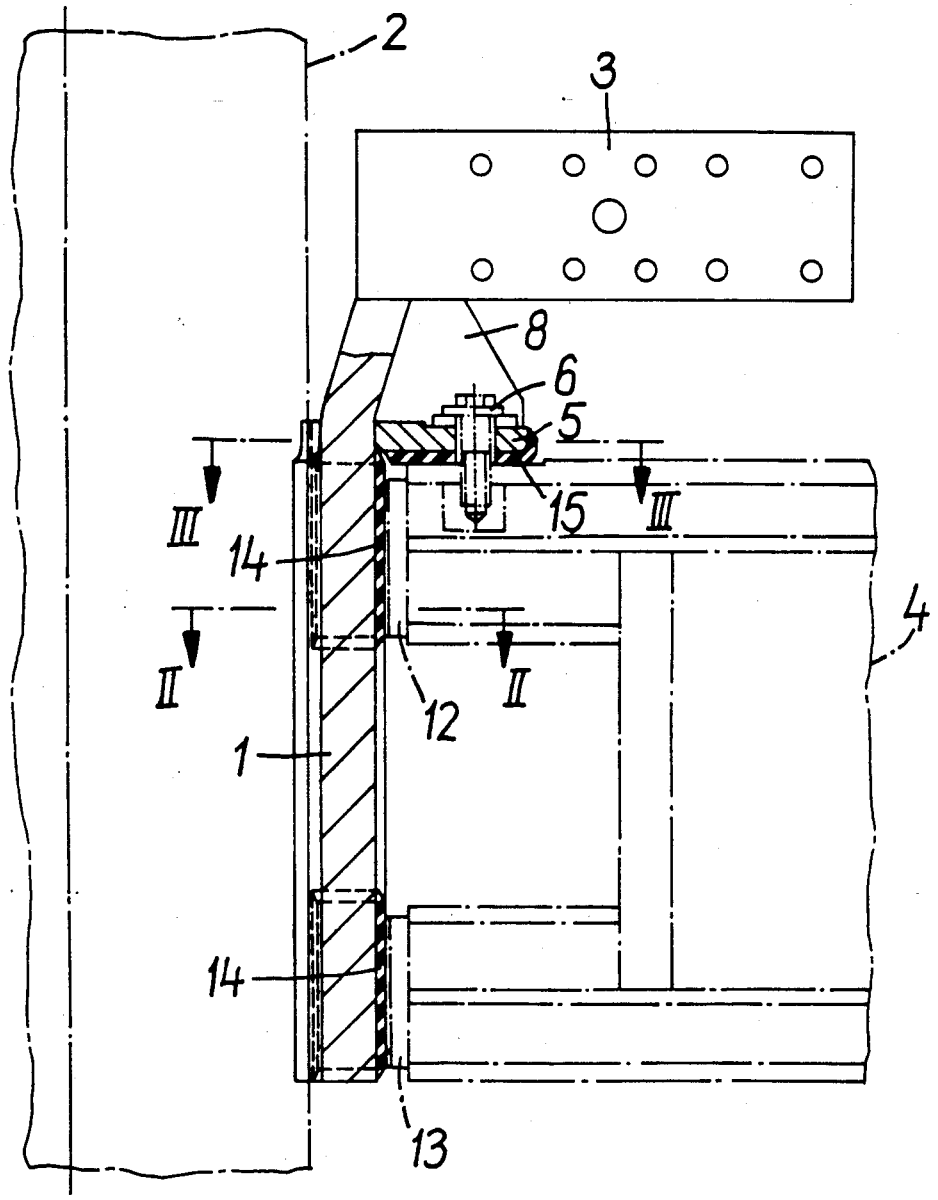
FIG. 1 is a central sectional view of a contact jaw according to the invention with the connecting members indicated.

As shown in the Figures, the contact jaw of the present invention includes a bar 1 which, in order to adapt it to the cylindrical surface of an electrode 2, is provided with a curved outer surface. Bar 1 is made of chromium-zirconium alloyed and heat treated hard copper. At its upper end bar 1 is provided with a lug 3 for connection with the current supplying leads (not illustrated). In order to fasten bar 1 to an electrode mount 4, which is brought radially to the electrode 2, in the region of its upper end bar 1 is provided with a bracket 5 which is supported at the upper side of electrode mount 4. Bracket 5 is fastened in an insulated manner by means of two connecting screws 6 which pass through bores 7 of bracket 5. Between lug 3 and bracket 5, a reinforcing web 8 is welded in.

At its side facing electrode 2, bar 1 is provided with a perpendicularly extending recess 9 so that symmetrical contact faces 10 result on both sides. Bar 1 is further provided with water cooling conduits 11. Electrode mount 4 has an upper contact face 12 and a lower contact face 13, both facing the electrode 2. Each of contact faces 12 and 13 is disposed opposite a respective coating 14 of ceramic insulating material that has been sprayed onto bar 1 at this location, as will be discussed below. Coatings 14 are substantially pure aluminum oxide. A coating 15 of the same thickness and of the same insulating material is also applied to the underside of bracket 5. For a better insulating effect, coating 15 extends around the lower edges of bracket 5 and merges into coating 14 at the corner between bar 1 and bracket 5. Between coatings 14 and 15 on the one hand and bar 1 or bracket 5, respectively, on the other hand, there is provided a metal adhesion layer 17 composed of a nickel-aluminum alloy.

Layer 17 is preferably applied using the so-called wire process, a variation of the so-called flame spraying process. A wire (not illustrated) of nickel-aluminum alloy is fed continuously through the gas-heated nozzle (not illustrated) of a spray gun. This causes the molten metal to be atomized by a jet of compressed air and to impinge on bar 1, which is prepared by roughening, at a velocity of about 200 m/sec. Coatings 14 and 15 of insulating material are preferably applied by a similar variation of the flame spraying process—the so-called powder process. Aluminum oxide in powder form is fed to a gas flame, melts, and is sprayed as indicated above. Layers 14, 15, and 17 are preferably 0.25 to 0.75 mm thick, depending upon the parameters of the electric furnace The supporting faces 12 and 13 of electrode mount 4 each grip around bar 1 by a certain amount as shown in FIG. 2. At the points where they pass around the side, a lateral guide 16 is worked into electrode mount 4 to prevent transverse movement of bar 1 under load.

During use of the contact jaw of the present invention, typically three such jaws are supported around an electrode 2 by an electrode mount 4. The electrode mount releasably clamps the contact jaws against the electrode 2, thereby both holding the electrode 2 and supplying electrical current to it.

It will be understood that the above description of the present invention is susceptible to various modifications, changes and adaptations, and the same are intended to be comprehended within the meaning and range of equivalents of the appended claims.

What I claim is:

1. In a contact jaw which is insulated from and releasably fastened to an electrode mount of an electric arc discharge furnace to transfer current from at least one input lead to an electrode, the contact jaw having at least one contact face that is directed toward the electrode mount, the improvement wherein:

the contact jaw is made of hard copper and, at least at said at least one contact face, a metal adhesion layer is disposed on the hard copper and a coating of ceramic insulating material is disposed on the metal adhesion layer.

2. A contact jaw as defined in claim 1, wherein the ceramic insulating material is substantially pure aluminum oxide and the metal adhesion layer is a nickel-aluminum alloy.

3. A contact jaw as defined in claim 2, wherein the ceramic insulating material comprises a coating sprayed on the metal adhesion layer.

4. A contact jaw as defined in claim 1, wherein the ceramic insulating material comprises a coating sprayed on the metal adhesion layer.

5. A contact jaw as defined in claim 1, wherein said jaw has a first side facing said electrode mount, said at least one contact face being disposed at said first side, a second side facing said electrode, and edges between said sides, wherein said coating of ceramic insulating material extends at least partially over said edges in addition to said at least one contact face, and wherein guides are disposed at said electrode mount to support said coating at said edges.

6. A contact jaw as defined in claim 1, wherein the hard copper of said contact jaw is a heat treated, chromium-zirconium alloy of copper.

7. A contact jaw as defined in claim 6, wherein the zirconium content ranges from about 0.003% to about 0.5% and whrein the chromium content ranges from about 0.3% to about 1.2%.

* * * * *